US008816944B2

(12) United States Patent
Kim et al.

(10) Patent No.: US 8,816,944 B2
(45) Date of Patent: Aug. 26, 2014

(54) DRIVING CURRENT OUTPUT APPARATUS, METHOD OF MANUFACTURING THE SAME, DISPLAY DEVICE AND DRIVING APPARATUS THEREOF

(75) Inventors: Tae-Whan Kim, Seoul (KR); Kae-Dal Kwack, Seoul (KR); Hong-Jae Shin, Seoul (KR)

(73) Assignee: Samsung Display Co., Ltd. (KR)

( * ) Notice: Subject to any disclaimer, the term of this patent is extended or adjusted under 35 U.S.C. 154(b) by 1080 days.

(21) Appl. No.: 11/453,529

(22) Filed: Jun. 15, 2006

(65) Prior Publication Data

US 2006/0290615 A1 Dec. 28, 2006

(30) Foreign Application Priority Data

Jun. 15, 2005 (KR) ..... 10-2005-0051537

(51) Int. Cl.
*G09G 3/30* (2006.01)

(52) U.S. Cl.
USPC ..... 345/78; 345/77

(58) Field of Classification Search
CPC ..... G09G 3/30; G09G 3/3208; G09G 3/3241; G09G 3/3283
USPC ..... 345/55, 76–78; 348/800; 315/169.3
See application file for complete search history.

(56) References Cited

U.S. PATENT DOCUMENTS

| | | | | |
|---|---|---|---|---|
| 2003/0006713 | A1* | 1/2003 | Kim et al. | 315/169.2 |
| 2003/0048669 | A1* | 3/2003 | Abe | 365/189.09 |
| 2003/0197473 | A1* | 10/2003 | Kitahara | 315/169.3 |
| 2004/0178742 | A1* | 9/2004 | Date et al. | 315/169.3 |
| 2004/0263437 | A1* | 12/2004 | Hattori | 345/76 |
| 2005/0156836 | A1* | 7/2005 | Yoneyama et al. | 345/76 |

* cited by examiner

*Primary Examiner* — Jonathan Horner
(74) *Attorney, Agent, or Firm* — Cantor Colburn LLP

(57) ABSTRACT

A display device, which includes a plurality of pixels; a data driver for outputting data signals to the pixels; a bias current outputting unit for outputting a bias current having a predetermined magnitude; a plurality of driving current outputting units for outputting driving currents to the pixels; and a first switch connected between the bias current outputting unit and the driving current outputting units for selecting one of the driving current outputting units to connect to the bias current outputting unit, wherein the magnitudes of the driving currents are substantially the same as a magnitude of the bias current.

15 Claims, 8 Drawing Sheets

DRIVING CURRENT OUTPUT APPARATUS, METHOD OF MANUFACTURING THE SAME, DISPLAY DEVICE AND DRIVING APPARATUS THEREOF

This application claims priority to Korean Patent Application No. 10-2005-0051537, filed on Jun. 15, 2005, and all the benefits accruing therefrom under 35 U.S.C. §119, the contents of which in its entirety are herein incorporated by reference.

BACKGROUND OF THE INVENTION (a) Field of the Invention

The present invention relates to a driving current output apparatus and a method of manufacturing the same, a display device, and a driving apparatus of the display device.

(b) Description of the Related Art

Liquid crystal displays ("LCDs") have been widely used as image display devices for TVs, computers and mobile phones. An LCD requires a backlight, and as a result, they are heavy, thick, and have a low response speed. Organic light emitting displays have been spotlighted as the next-generation image display device that may replace the LCD. The organic light emitting display includes a very thin organic thin film of 0.1 μm or less in thickness. When current flows through the organic thin film, the organic thin film emits light since electrons and holes are recombined near the interface of an electron transport layer and a hole transport layer. The light emission has a rapid response time of several hundreds of nanoseconds (ns) or less.

Organic light emitting displays have a plurality of organic light emitting diodes ("OLEDs"), which are current-controlled devices. In addition the display also contains a driving current generator, which generates a plurality of driving currents to supply to the OLEDs. It is preferable that the driving currents are substantially uniform. However, due to operation characteristics of electric elements such as transistors, which are included in the driving current generator or variations of a supply voltage, magnitudes of the driving currents from the driving current generator are not currently uniform, the effect of which is to decrease image quality of the organic light emitting display.

BRIEF SUMMARY OF THE INVENTION

According to an exemplary embodiment of the present invention, a driving current output apparatus includes a bias current outputting unit which outputs a bias current having a predetermined magnitude; and a driving current outputting unit which outputs a driving current based on the bias current and is connected to the bias current outputting unit, wherein a magnitude of the driving current is substantially the same as that of the bias current.

In another exemplary embodiment, the driving current outputting unit may be a driving current outputting circuit and may include a first transistor connected between a driving voltage and the bias current outputting unit, a first switch connected to the first transistor; a second transistor connected between the first switch and the driving current; and a capacitor connected to the driving voltage and the second transistor.

Another exemplary embodiment provides that the driving current outputting unit may have at least two driving current outputting circuits, and the apparatus may further include a second switch connected to the bias current outputting unit and the driving current outputting circuits which selects one of the driving current outputting circuits, to connect to the bias current outputting unit.

In yet another exemplary embodiment the first switch may be synchronized with the second switch.

According to another exemplary embodiment of the present invention, a display device includes: a plurality of pixels; a data driver which outputs data signals to the pixels; a bias current outputting unit which outputs a bias current having a predetermined magnitude to a driving current outputting unit; a plurality of driving current outputting units which output driving currents to the pixels; and a first switch connected between the bias current outputting unit and the driving current outputting units which selects one of the driving current outputting units to connect to the bias current outputting unit, wherein magnitudes of the driving currents are substantially the same as a magnitude of the bias current.

Alternative embodiments include configurations where the respective driving current outputting units may include a first transistor connected between a driving voltage and the bias current outputting unit; a second switch connected to the first transistor; a capacitor connected between the driving voltage and the connection between the second transistor and the second switch; and a second transistor connected between the second switch and the driving current.

Other alternative embodiments include configurations where the respective driving current outputting units may include a first transistor supplied with a driving voltage and for defining a magnitude of a voltage between a control terminal and an input terminal based on the bias current, a second switch connected to the first transistor; a capacitor connected between the second switch and the driving voltage; and a second transistor having an input terminal connected to the driving voltage, a control terminal connected to the second switch, and an output terminal for outputting the driving current.

In yet another exemplary embodiment the first switch may be synchronized with the second switch.

In another exemplary embodiment the data driver may include a shift register sequentially supplied with image data; a latch which stores the image data from the shift register; and a pulse width modulation circuit which modulates widths of pulses based on the image data from the latch, to output the pulse width modulation signals as data signals to the pixels.

In another exemplary embodiment the display device may be an organic light emitting display.

In another exemplary embodiment the display device may be a passive matrix organic light emitting display.

According to another exemplary embodiment of the present invention, a driving apparatus of a display device having a plurality of pixels containing organic light emitting diodes includes a data driver which outputs data signals to the pixels; a bias current outputting unit which outputs a bias current having a predetermined magnitude to a driving current outputting unit; a plurality of driving current outputting units which output driving currents to the pixels; and a selecting switch connected between the bias current outputting unit and the driving current outputting units which selects one of the driving current outputting units to connect to the bias current outputting unit, wherein magnitudes of the driving currents are substantially the same as that of the bias current.

In another exemplary embodiment the data driver may include a shift register sequentially supplied with image data; a latch which stores the image data from the shift register; and a pulse width modulation circuit which modulates widths of pulses based on the image data from the latch, to output the pulse width modulation signals as data signals to the pixels.

In another exemplary embodiment the selecting switch may be synchronized with the shift register.

Alternative exemplary embodiments of the invention include a method of manufacturing a driving current output apparatus including forming a bias current output unit which outputs a bias current having a predetermined magnitude; and forming a driving current outputting unit which outputs a driving current based on the bias current connected to the bias current output unit, wherein the magnitude of the driving current is substantially the same as that of the bias current.

BRIEF DESCRIPTION OF THE DRAWINGS

The above and other features and advantages of the present invention will become more apparent by describing exemplary embodiments thereof with reference to the attached drawings in which.

DETAILED DESCRIPTION OF THE INVENTION

Figure 1A:
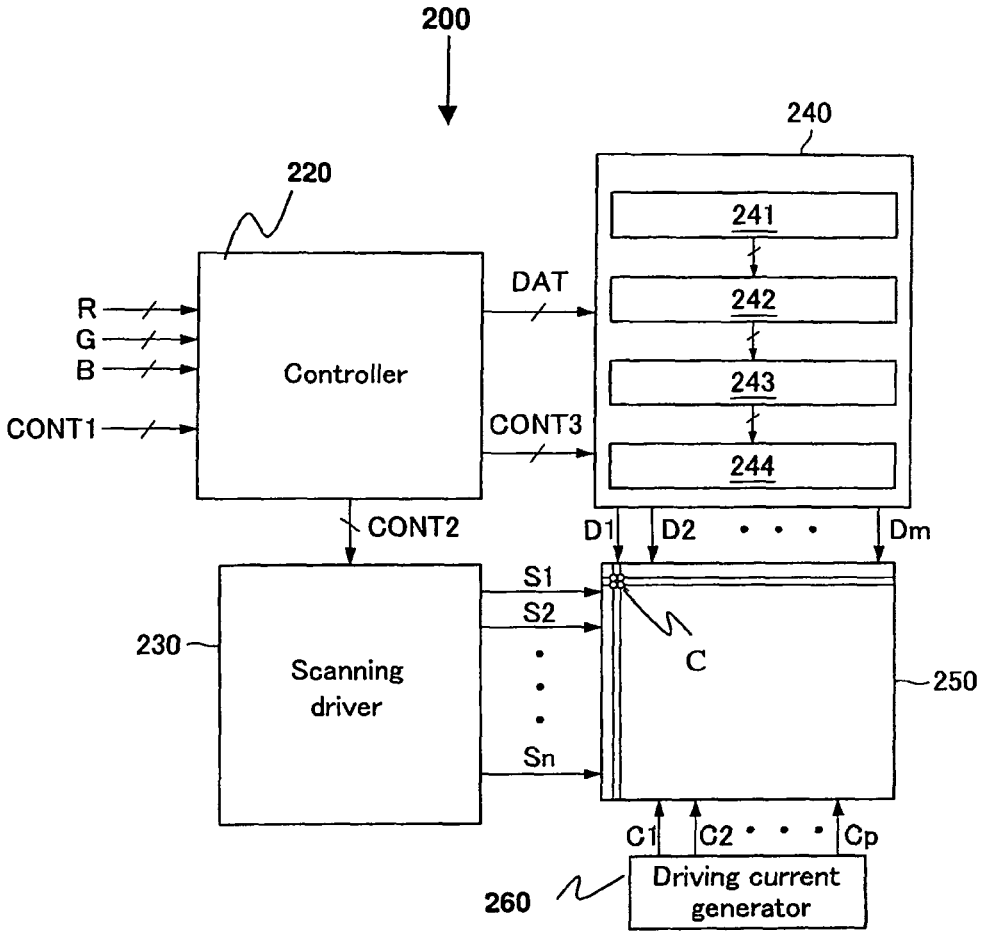
FIG. 1A is a block diagram of an exemplary embodiment of an organic light emitting display according to the present invention.

The present invention will now be described more fully hereinafter with reference to the accompanying drawings, in which exemplary embodiments of the present invention are shown. The present invention may, however, be embodied in many different forms and should not be construed as being limited to the exemplary embodiments set forth herein. Rather, these exemplary embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present there between. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments of the present invention are described herein with reference to cross section illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

Exemplary embodiments of display devices and driving apparatus of the display devices according to exemplary embodiments of the present invention will now be described with reference to the drawings. An example of the organic light emitting display according to an exemplary embodiment of the present invention is a color passive matrix organic light emitting display. However, it is to be understood that the present invention is not limited to the color passive matrix organic light emitting display.

Figure 2:
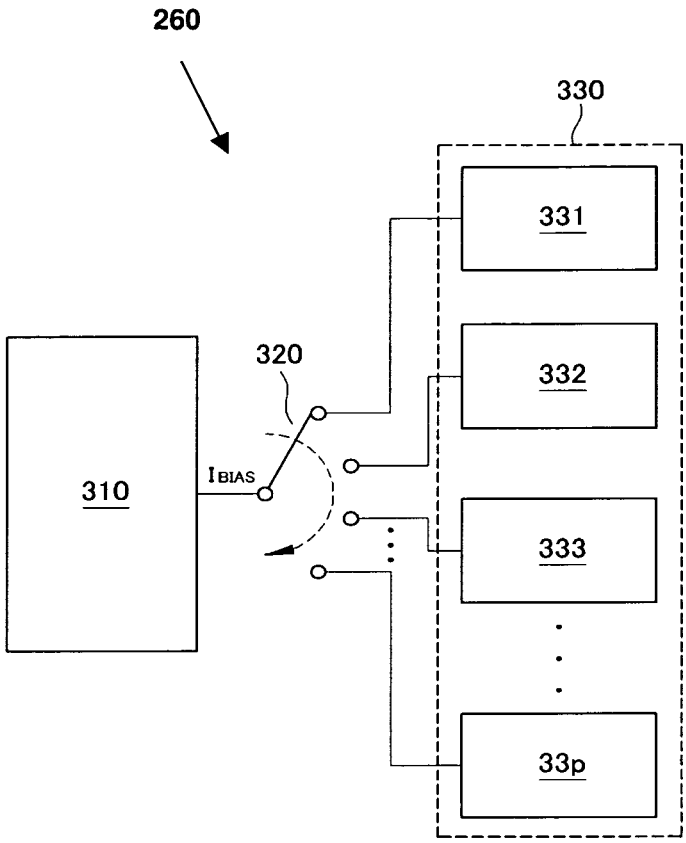
FIG. 2 is a block diagram of an exemplary embodiment of a driving current generator according to the present invention.

FIG. 1A is a block diagram of an exemplary embodiment of an organic light emitting display according to the present invention and FIG. 2 is a block diagram of an exemplary embodiment of a driving current generator according to the present invention.

Referring to FIG. 1A, an organic light emitting display 200 according to an exemplary embodiment of the present invention includes a controller 220, a scanning driver 230 and a data driver 240 connected to the controller 220, a driving current generator 260, and a display panel 250 connected to the drivers 230 and 240 and driving current generator 260.

Figure 1B:
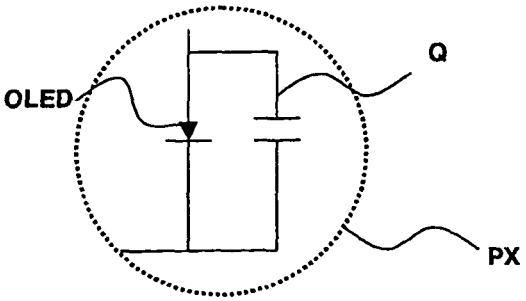
FIG. 1B is an enlarged view of the area covered by circle C in FIG. 1A

Referring to FIGS. 1A and 1B, the display panel 250 includes a plurality of pixels PX connected to a plurality of signal lines S1-Sn, D1-Dm, and C1-Cp, and arranged in a matrix.

Each pixel PX includes an organic light emitting diode ("OLED") and a switching element Q.

The signal lines S1-Sn, D1-Dm, and C1-Cp include a plurality of scanning signal lines S1-Sn for transmitting scanning signals, a plurality of data lines D1-Dm for transmitting data signals, and a plurality of driving current lines C1-Cp for transmitting driving currents. The scanning signal lines S1-Sn extend substantially in a row direction and are substantially parallel to each other, while the data lines D1-Dm and the driving current lines C1-Cp extend substantially in a column direction and are substantially parallel to each other. The number of the data lines D1-Dm is same as that of the driving current lines C1-Cp.

The switching element Q, an exemplary embodiment of which is a thin film transistor ("TFT"), has three terminals: an input terminal connected to one of the driving current lines C1-Cp; a control terminal connected to one of the data lines D1-Dm; and an output terminal connected to one of the OLEDs.

The OLED includes an anode terminal connected to an output terminal of the switching element Q and a cathode terminal connected to one of the scanning lines S1-Sn.

The controller 220 is supplied with input image signals R, G, and B and input control signals CONT1 for controlling the display thereof from an external graphics controller (not shown).

The controller 220 generates scanning control signals CONT2 and data control signals CONT3, and processes the image signals R, G, and B to be suitable for the operation of the display panel 250 on the basis of the input control signals CONT1 and the input image signals R, G and B. The controller 220 then transmits the scanning control signals CONT2 to the scanning driver 230, and transmits the processed image signals DAT and the data control signals CONT2 to the data driver 240.

Responsive to the scanning control signals CONT2 from the controller 220, the scanning driver 230 sequentially applies the scanning signals to the scanning signal lines S1-Sn. The scanning signal includes a low level and a high level.

The data driver 240 includes a shift register 241, a sampling latch 242 connected to the shift register 241, a pulse width modulation ("PWM") circuit 243 connected to the sampling latch 242, and a level shifter 244 connected to the PWM circuit 243. The level shifter 244 may be omitted if it is not needed. Responsive to the data control signals CONT3 from the controller 220, the data driver 240 controls turn-on/turn-off time of the switching elements Q based on magnitudes of the image data DAT from the controller 220.

That is, the shift register 241 receives the data control signals CONT3 such as a clock signal (not shown) and a horizontal synchronization start signal (not shown) and the image data DAT from the controller 220. The shift register 241 sequentially shifts the image data DAT in synchronization with the clock signal.

The sampling latch 242 stores image data DAT which is received from the shift register 241.

The PWM circuit 243 generates PWM signals having pulse widths defined by magnitudes of the image data DAT and outputs the PWM signals to the control terminals of the switching elements Q as data signals. That is, the pulse widths of the PWM signals are varied by gray scales corresponding to the image data DAT.

The level shifter 244 shifts levels of the PWM signals from the PWM circuit 243 into predetermined levels. However, level shifters are not required in all OLED display devices and the inclusion of one here in this exemplary embodiment is for illustrative purposes only and does not limit the scope of the present invention.

The driving current generator 260 outputs a plurality of driving currents applied to the input terminals of the switching elements Q. An exemplary embodiment of the driving current generator 260 may be controlled by the data control signals CONT3 from the controller 220, to operate in synchronization with the shift register 241 of the data driver 240. In another exemplary embodiment the driving current generator 260 may be controlled by separate control signals. Exemplary embodiments provide that the driving current generator 260 may be included into the data driver 240; the scanning driver 230; or it may be integrated with the display panel 250. In yet another exemplary embodiment the driving current generator 260 may be designed into a separate device 260 to be disposed outside or inside of the display panel 250.

The driving current generator 260 will be described in detail with reference to FIG. 2. Referring to FIG. 2, the driving current generator 260 includes a main current bias circuit 310, a selecting switch 320 connected to the main current bias circuit 310, and a sample and hold unit 330 connected to the selecting switch 320 and the driving current lines C1-Cp (shown in FIG. 1, but not in FIG. 2).

The sample and hold unit 330 includes a plurality of sample and hold circuits 331-33*p* which are each connected to the driving current lines C1-Cp, respectively.

The main current bias circuit 310 outputs a bias current $I_{BIAS}$ corresponding to driving currents, which are output through the driving current lines C1-Cp.

In synchronization with a clock signal applied to the shift register 241 of the data driver 240, the selecting switch 320 sequentially selects the first sample and hold current 331 to the final sample and hold current 33*p*, to supply the bias current $I_{BIAS}$ from the main current bias circuit 310 to the selected sample and hold circuit 331-33*p*.

The sample and hold circuits 331-33*p* have substantially the same structures and carry out substantially the same operations as each other. Therefore, for purposes of illustration only the first sample and hold circuit 331 connected to the first driving current line C1, the first scanning signal line S1, and the first data line D1 will be described with reference to FIG. 3.

Figure 3:
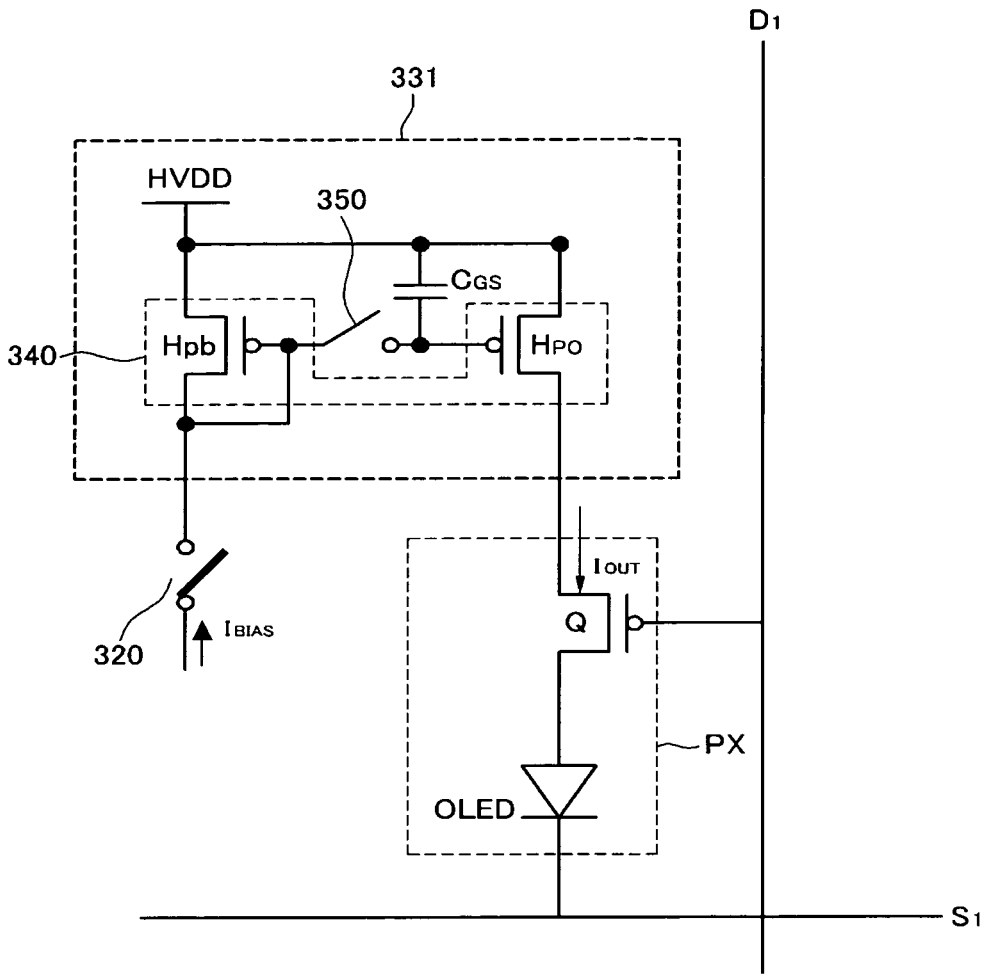
FIG. 3 is an equivalent circuit diagram of an exemplary embodiment of one first sample and hold circuit of the plurality of sample and hold circuits of the driving current generator shown in FIG. 2

Referring to FIG. 3, the sample and hold circuit 331 includes a current sink unit 340, a hold switch 350, and a storage capacitor $C_{GS}$.

The current sink unit 340 includes a bias transistor Hpb and an output transistor Hpo and functions as a current mirror circuit.

The bias transistor Hpb has three terminals: an input terminal connected to a driving voltage HVDD; a control terminal connected to one end of the hold switch 350; and an output terminal connected to the channel selecting switch 320.

The bias transistor Hpo also has three terminals: an input terminal connected to the driving voltage HVDD; a control terminal connected to another end of the hold switch 350; and an output terminal connected to a driving current line C1.

The storage capacitor $C_{GS}$ is connected between the driving voltage HVDD and the control terminal of the output transistor Hpo.

When the bias current $I_{BIAS}$ is applied to the output terminal of the bias transistor Hpb as a sink current, the current sink unit 340 outputs a current having a magnitude substantially equal to that of the bias current $I_{BIAS}$ as a driving current.

That is, the first sample and hold circuit 331 is selected by the selecting switch 320, and thereby the bias current $I_{BIAS}$ is applied to the output terminal of the bias transistor Hpb of the selected sample and hold circuit 331. At this time, as described above, the hold switch 350 is turned-on in synchronization with the selecting of the selecting switch 320.

Thereby, based on the inputted bias current $I_{BIAS}$, a voltage $V_{GS}$ between the control terminal and the input terminal of the bias transistor Hpb is defined, and then the voltage $V_{GS}$ is charged in the storage capacitor $C_{GS}$ through the hold switch 350. That is, the voltage $V_{GS}$ has a magnitude to cause the bias current $I_{BIAS}$ to flow through the output terminal of the bias transistor Hpb. Thereby, the magnitude of the voltage $V_{GS}$ is varied based on process parameters of transistors Hpb and Hpo and variation of the driving voltage HVDD, to cause the bias current $I_{BIAS}$ to flow. This process will be described in detail with reference to Equation 1.

The output transistor Hpo outputs an output current Iout, which has a defined magnitude based on the charged voltage $V_{GS}$ of the storage capacitor $C_{GS}$. That is, the output current Iout is based on a voltage between the control terminal and the input terminal of the output transistor Hpo, as a driving voltage. As described above, since the voltage $V_{GS}$ of the bias transistor Hpb is charged in the storage capacitor $C_{GS}$, the voltage between the control terminal and the input terminal of the output transistor Hpo is the same as $V_{GS}$. The result is that the magnitude of the output current Iout from the output transistor Hpo is substantially equal to that of the bias current $I_{BIAS}$.

Next, when the selecting switch 320 selects the second sample and hold circuit 332, the hold switch 350 of the first sample and hold circuit 331 is turned-off. However, because the storage capacitor $C_{GS}$ has been charged, the first sample and hold circuit 331 still outputs the output current Iout having a magnitude substantially equal to that of the bias current $I_{BIAS}$.

By repeating this procedure, the output currents Iout from the first sample and hold circuit to the final sample and hold circuit 33*p* all have a magnitude substantially equal to that of the bias current $I_{BIAS}$.

After applying the low level scanning signal to the scanning signal line S1-Sn, when a load signal for instructing to apply the data signals to the data lines D1-Dm is applied to the data driver 240, the PWM signals from the PWM circuit 243 are applied to the control terminals of the switching elements Q. Turn-on and turn-off periods are varied based on the widths of the PWM signals, and thereby amounts of current applied to the OLEDs are controlled to display desired images.

As described above, since the bias current $I_{BIAS}$ is applied to all of the sample and hold circuits 331-33*p* and the voltage $V_{GS}$ of the bias transistor Hpb is defined based on the bias current $I_{BIAS}$, magnitudes of the output currents Iout from the sample and hold circuits 331-33*p* are substantially the same as each other.

The operations of the sample and hold unit 330 are repeated before data signals are applied to every pixel row, that is, the load signal is applied to the data driver 240.

The following Equation 1 represents the output current Iout outputted from an output transistor Hpo of the $p^{th}$ sample and hold circuit 33*p*.

$$I_{out} = (\mu_p + \Delta\mu_p)(C_{OX} + \Delta C_{OX}) \times \frac{(W + \Delta W)}{(L + \Delta L)}(V_{GS} - |V_{THP} \pm \Delta V_{THP}|)^2 \quad \text{[Equation 1]}$$

where "$\mu_p$" and "$\Delta\mu_p$" designate the field-effect mobility and the variation ratio of the mobility, "$C_{ox}$" and "$\Delta C_{ox}$" designate the parasitic capacitance of the output transistor Hpo and the variation ratio of the capacitance, "L" and "ΔL" designate the channel length of the output transistor Hpo and the variation rate of the channel length, "W" and "ΔW" designate the channel width of the output transistor Hpo and the variation ratio of the channel width, and "$V_{THP}$" and "$\Delta V_{THP}$" designate the threshold voltage of the output transistor Hpo and the variation ratio of the threshold voltage. Furthermore, "$V_{GS}$" designates a voltage, which is charged in the storage capacitor, between the control terminal and the input terminal of the bias transistor Hpb.

As described above, since the magnitudes of the bias current $I_{BIAS}$ and the output current Iout are substantially equal to each other, in Equation 1, the output current $I_{OUT}$ is substituted by the bias current $I_{BIAS}$, and thereby the magnitude of the voltage $V_{GS}$ is determined. Therefore, if process parameters of the transistors of each sample and hold circuit 331-33*p* are changed, a different $V_{GS}$ may be applied to each sample and hold circuit 331-33*p*.

Characteristics of the output currents of an exemplary embodiment of the driving current generator 260 according to the present invention will be described with reference to FIGS. 4A to 5B.

Figure 4A:
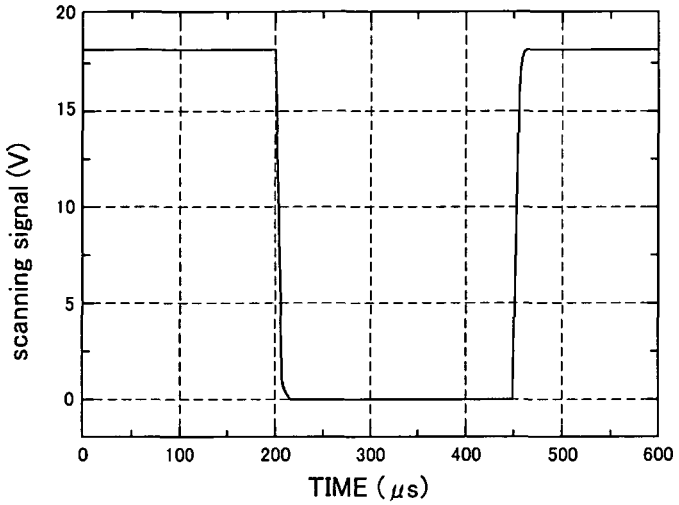
FIG. 4A is a graph illustrating an exemplary embodiment of a waveform of a scanning signal applied to the $n^{th}$ scanning signal line of the scanning driver.
Figure 4B:
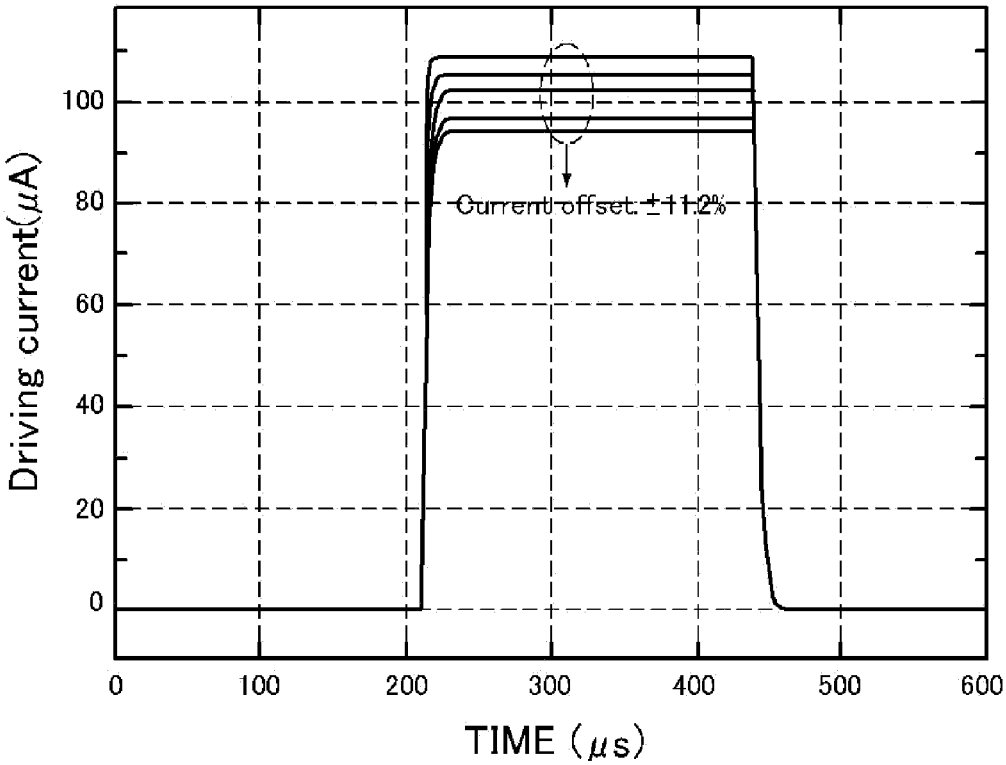
FIG. 4B (PRIOR ART)
FIG. 4B is a graph illustrating waveforms of a predetermined number, in this example five output currents outputted from a driving current generator of the prior art when the scanning signal shown in FIG. 4A is applied.
Figure 4C:
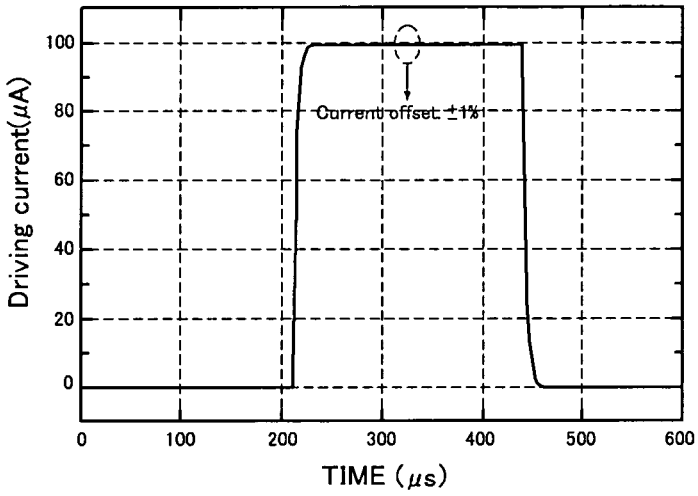
FIG. 4C is a graph illustrating waveforms of five output currents outputted from an exemplary embodiment of a driving current generator according to the present invention when the scanning signal shown in FIG. 4A is applied.

FIG. 4A is a graph illustrating a waveform of an exemplary embodiment of a scanning signal applied to the $n^{th}$ scanning signal line of the scanning driver. FIG. 4B is a graph illustrating waveforms of a predetermined number, in this example five output currents outputted from a driving current generator according to the prior art when the scanning signal shown in FIG. 4A is applied, and FIG. 4C is a graph illustrating waveforms of five output currents outputted from an exemplary embodiment of a driving current generator according to the present invention when the scanning signal shown in FIG. 4A is applied. Furthermore, FIG. 5A is a graph illustrating waveform variations of an output current of a driving current generator according to the prior art when process parameters are changed according to a Monte Carlo simulation, and FIG. 5B is a graph illustrating waveform variations of an exemplary embodiment of an output current of a driving current generator according to the present invention when process parameters are changed according to a Monte Carlo simulation.

When a scanning signal applied to the $n^{th}$ scanning signal line Sn has a low voltage level, as shown in FIG. 4A, five different resulting output currents from a driving current generator according to the prior art are shown in FIG. 4B. As shown in FIG. 4B, deviation of the five output currents was about ±11.2% and the deviation was very large.

Referring to FIG. 4C, deviation of five output currents from an exemplary embodiment of the driving current generator 260 according to the present invention was about ±1%, which is smaller than that of the prior art.

Figure 5A:
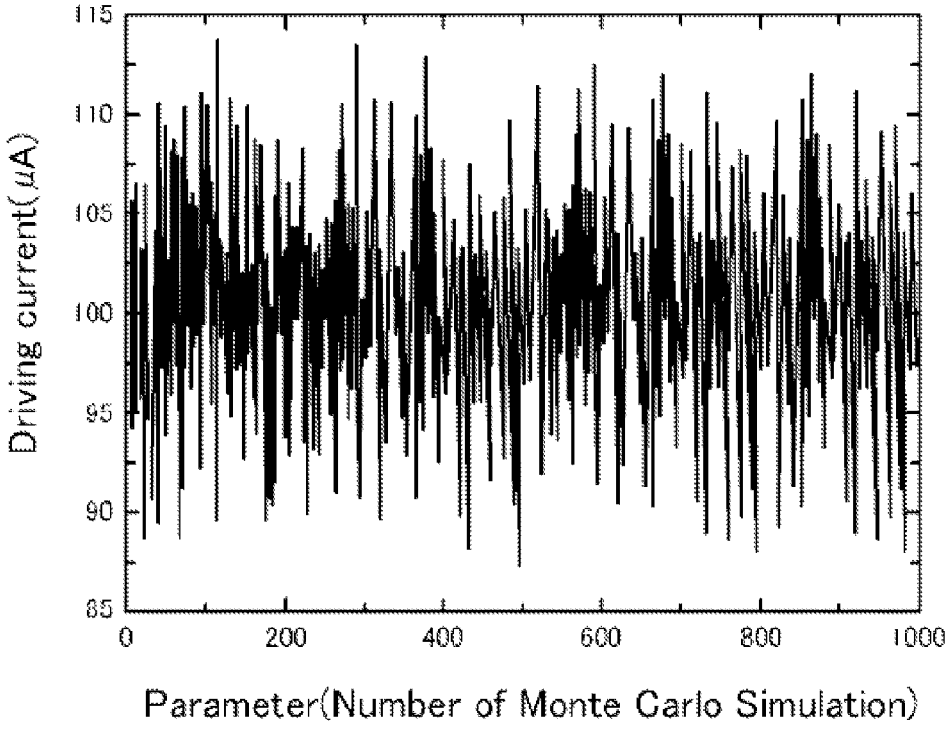
FIG. 5A (PRIOR ART)
FIG. 5A is a graph illustrating waveform variations of an output current of a driving current generator of the prior art when process parameters are changed according to a Monte Carlo simulation.
Figure 5B:
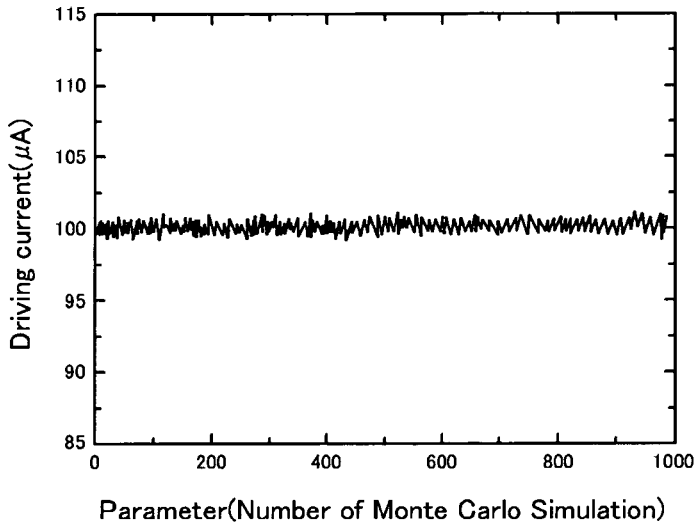
FIG. 5B is a graph illustrating waveform variations of an exemplary embodiment of an output current of a driving current generator according to the present invention when process parameters are changed according to a Monte Carlo simulation.

Referring to FIGS. 5A and 5B, when process parameters (for example, threshold voltage, field effect mobility, parasitic capacitance, channel length, channel width, etc.) of transistors were changed through a Monte Carlo simulation, a width of variation of an output current from an exemplary embodiment of a driving current generator according to the present invention was narrower than a width of variation of an output current from a driving current generator of the prior art.

According to the present invention, driving currents from a driving current generator have substantially the same magnitude, and thereby deviation of the driving currents decreases.

By using a selecting switch, the same bias current may be applied to any one of a plurality of sample and hold circuits, and driving currents having magnitudes substantially equal to that of the bias current may be outputted and applied to pixels in spite of variation of various parameters of the transistors of the sample and hold circuits and variation of a driving voltage. Therefore, image deterioration due to variation of the driving currents is reduced or effectively prevented.

While the present invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims, the detailed description, and the accompanying drawings of the present invention. Therefore, it is natural that such modifications belong to the scope of the present invention.

What is claimed is:

1. A driving current output apparatus comprising:

a bias current outputting unit which outputs a bias current having a predetermined magnitude;

a driving current outputting unit comprising a plurality of driving current outputting circuits, each of the plurality of driving current outputting circuits being sequentially connected to an output terminal of the bias current outputting unit through a single selecting switch which selects one of the driving current outputting circuits sequentially to be connected to the output terminal of the bias current outputting unit, a driving current outputting circuit of the plurality of driving current outputting circuits outputting a driving current based on the bias current to an input terminal of a switching element included in a pixel and connected to a light emitting element; and a pulse width modulation circuit which generates PWM signals having pulse widths defined by magnitudes of image data and outputs the PWM signals to a control terminal of the switching element to control turn-on and turn-off periods of the switching element, wherein the driving current outputting circuit comprising:

a first transistor connected between a driving voltage and the bias current outputting unit;

a first switch comprising an end connected directly to a gate of the first transistor;

a second transistor comprising a gate connected directly to another end of the first switch, a drain connected to the driving voltage, and a source connected to the switching element; and a capacitor connected to the driving voltage and the gate of the second transistor.

2. The apparatus of claim 1, wherein the first switch is synchronized with the single selecting switch.

3. A display device comprising:

a plurality of pixels;

a plurality of switching elements respectively included in the plurality of pixels and connected to light emitting elements and having control terminals;

a data driver which outputs data signals to the control terminals of the switching elements to control turn-on and turn-off periods of the switching elements;

a bias current outputting unit which outputs a bias current having a predetermined magnitude;

a plurality of driving current outputting units which output driving currents to input terminals of the switching elements; and a single first switch connected between the bias current outputting unit and the driving current outputting units, the single first switch sequentially selecting one of the driving current outputting units to be connected to an output terminal of the bias current outputting unit, wherein the respective driving current outputting units comprise:

a first transistor connected between a driving voltage and the bias current outputting unit;

a second switch comprising an end connected directly to a gate of the first transistor;

a second transistor comprising a gate connected directly to another end of the second switch, a drain connected to the driving voltage, and a source connected to one of the switching elements; and a capacitor connected between the driving voltage and the gate of the second transistor, wherein the plurality of switching elements controls amounts of the driving currents applied to the pixels.

4. The device of claim 3, wherein the single first switch is synchronized with the second switch.

5. The device of claim 4, wherein the data driver comprises:

a shift register sequentially supplied with image data;

a latch which stores the image data from the shift register; and a pulse width modulation circuit which modulates widths of pulses based on the image data from the latch, and outputs the pulse width modulation signals as data signals to the pixels.

6. The device of claim 3, wherein the display device is an organic light emitting display.

7. The device of claim 6, wherein the display device is a passive matrix organic light emitting display.

8. The device of claim 3, wherein the first transistor is supplied with the driving voltage and defines a magnitude of a voltage between a control terminal and an input terminal based on the bias current, and the second transistor further comprises an input terminal connected to the driving voltage.

9. The device of claim 8, wherein the first switch is synchronized with the second switch.

10. The device of claim 9, wherein the data driver comprises:

a shift register sequentially supplied with image data;

a latch which stores the image data from the shift register; and a pulse width modulation circuit which modulates widths of pulses based on the image data from the latch, and outputs the pulse width modulation signals as data signals to the pixels.

11. A driving apparatus of a display device having a plurality of pixels containing organic light emitting diodes, the apparatus comprising:

a plurality of switching elements respectively included in the plurality of pixels and connected to the organic light emitting diodes and having control terminals;

a data driver which outputs data signals to the control terminals of the switching elements to control turn-on and turn-off periods of the switching elements;

a bias current outputting unit which outputs a bias current having a predetermined magnitude;

a plurality of driving current outputting units which output driving currents to input terminals of the switching elements; and a single selecting switch connected between the bias current outputting unit and the driving current outputting units, the single selecting switch sequentially selecting one of the driving current outputting units to be connected to an output terminal of the bias current outputting unit, wherein the respective driving current outputting units comprise:

a first transistor connected between a driving voltage and the bias current outputting unit;

a switch comprising an end connected directly to a gate of the first transistor;

a second transistor comprising a gate connected directly to another end of the switch, a drain connected to the driving voltage, and a source connected to one of the switching elements;

a capacitor connected to the driving voltage and the gate of the second transistor, and wherein the plurality of switching elements controls amounts of the driving currents applied to the organic light emitting diodes.

12. The apparatus of claim 11, wherein the data driver comprises:

a shift register sequentially supplied with image data;

a latch which stores the image data from the shift register; and a pulse width modulation circuit which modulates widths of pulses based on the image data from the latch, to output the pulse width modulation signals as data signals to the pixels.

13. The apparatus of claim 12, wherein the single selecting switch is synchronized with the shift register.

14. A method of manufacturing a driving current output apparatus comprising:

forming a switching element included in a pixel and connected to a light emitting element and having a control terminal;

forming a bias current output unit which outputs a bias current having a predetermined magnitude;

forming a driving current outputting unit sequentially connected to an output terminal of the bias current outputting unit through a single selecting switch, the driving current outputting unit outputting a driving current based on the bias current to an input terminal of the switching element; and forming a pulse width modulation circuit which generates PWM signals having pulse widths defined by magnitudes of image data and outputs the PWM signals to the control terminal of the switching element to control turn-on and turn-off periods of the switching element, wherein the driving current outputting unit comprising:

a first transistor connected between a driving voltage and the bias current outputting unit;

a first switch comprising an end connected directly to a gate of the first transistor;

a second transistor comprising a gate connected directly to another end of the first switch and a drain connected to the driving voltage, and a source connected to the switching element; and a capacitor connected to the driving voltage and the gate of the second transistor.

15. The apparatus of claim 2, wherein the second switch is connected to the bias current outputting unit and the driving current outputting circuits which selects one of the driving current outputting circuits to connect to the bias current outputting unit.

* * * * *

UNITED STATES PATENT AND TRADEMARK OFFICE

CERTIFICATE OF CORRECTION

PATENT NO. : 8,816,944 B2
APPLICATION NO. : 11/453529
DATED : August 26, 2014
INVENTOR(S) : Tae-Whan Kim et al.

It is certified that error appears in the above-identified patent and that said Letters Patent is hereby corrected as shown below:

On the title page, Item (73), Assignee, delete "Samsung Display Co., Ltd. (KR)" and insert therefor -- Samsung Display Co., Ltd. (KR); INDUSTRY- UNIVERSITY COOPERATION FOUNDATION, HANYANG UNIVERSITY (KR) --

Signed and Sealed this
Twelfth Day of May, 2015

Michelle K. Lee

Michelle K. Lee
*Director of the United States Patent and Trademark Office*